United States Patent [19]

Loeffler

[11] 4,168,959

[45] Sep. 25, 1979

[54] METHOD AND APPARATUS FOR DISTRIBUTION OF GLASS FIBERS

[75] Inventor: Romain E. Loeffler, Littleton, Colo.

[73] Assignee: Johns-Manville Corporation, Denver, Colo.

[21] Appl. No.: 842,638

[22] Filed: Oct. 17, 1977

Related U.S. Application Data

[63] Continuation-in-part of Ser. No. 769,086, Feb. 16, 1977, abandoned.

[51] Int. Cl.[2] ..... C03B 37/04

[52] U.S. Cl. ..... 65/3 R; 65/4 R; 65/9; 264/115; 264/121

[58] Field of Search ..... 65/2, 3 R, 4 R, 9, 11 R, 65/5, 16; 264/115, 121

[56] References Cited

U.S. PATENT DOCUMENTS

| | | | |
|---|---|---|---|
| 2,230,270 | 2/1941 | Simpson | 65/9 |
| 3,445,207 | 5/1969 | Goerens | 65/9 |
| 3,546,898 | 12/1970 | Langlois et al. | 65/4 R X |
| 3,787,195 | 1/1974 | Kircheim | 65/16 X |
| 3,819,441 | 6/1974 | Fargo et al. | 65/4 R X |
| 3,844,751 | 10/1974 | Stewart | 65/4 |

*Primary Examiner*—Robert L. Lindsay, Jr.
*Attorney, Agent, or Firm*—Robert M. Krone; Joseph J. Kelly; William C. Anderson

[57] ABSTRACT

In the manufacture of glass fibrous products wherein gaseous streams of fibers are directed through conduits from a generally horizontal direction downwardly in a generally vertical direction towards a moving collection surface, the improvement wherein forming tubes are telescopically associated with downwardly sloping portions of the conduits and supported so that the forming tubes may be positioned at various distances above the collection surface and at various angular orientations relative to the moving collection surface. Also, the shaping of the forming tubes allows additional gaseous streams of fibers to be produced. By selectively manipulating the height and orientation of the forming tubes, the ability to produce a uniform deposition of material onto the moving collection surface is greatly improved. A method and apparatus for the application of binder is also disclosed. Binder atomizing nozzles are located at the periphery of the discharge ports of the individual forming tubes and can be adjusted to be held at any angle desired, thereby producing improved binder distribution onto the glass fibers.

23 Claims, 5 Drawing Figures

METHOD AND APPARATUS FOR DISTRIBUTION OF GLASS FIBERS

CROSS-REFERENCE TO RELATED APPLICATIONS

This application is a Continuation-In-Part of copending application Ser. No. 769,086, which was filed Feb. 16, 1977, entitled "Method and Apparatus for Distribution of Glass Fibers", and now abandoned.

BACKGROUND OF THE INVENTION

This invention pertains to the production of mats of glass fibers. In a conventional manner continuous primary filaments of glass are fed into an intensely hot, high speed gaseous blast which attenuates the glass into fine fibers. A battery of burners is utilized to produce the generally horizontal blasts, and the gaseous streams of fibers are conducted via forming tubes to be discharged onto a moving foraminous collection surface. Generally, as shown in Canadian Pat. No. 980,969, a common forming tube is employed although, as disclosed in U.S. Pat. No. 3,076,236, a battery of fixedly mounted forming tubes can be utilized to deliver fibers into the region of the collection surface. On each side of the forming tube, adjacent the discharge end, is located a high pressure binder header having a plurality of stationary, longitudinally extending atomizing nozzles. Binder flow to each of the nozzles is individually controlled by suitable valve means. In operation the nozzles cause the binder solution to be atomized into a cloud of mist through which the fibrous stream passes. In seeking an even distribution of binder in the resultant fiber glass mat under the conventional method, individual nozzles are selectively shut off or turned on until an adequate spray pattern is achieved, that is, until binder is evenly and adequately dispersed onto the glass fibers.

Although the pot melt rate, pull roll speeds and burner pressures of a typical fiber mat producing apparatus may be uniformly set, there is never actually complete uniformity of fiber production across the machine hot-end because of the inevitable fine but appreciable distinctions between each of the fiber generating means. Another relevant machine characteristic is shown by the fact that the stream of high velocity gases and induced air has a considerable amount of energy which causes a high degree of turbulence within the forming tube as well as channeling of the flow path through the collection surface. One effect of the complicated gaseous flow pattern and of the variations in fiber generation across the machine hot-end is that deposition of glass fibers upon the moving collection surface is not uniform.

Under prior methods, in order to assure that manufacturing specifications are adhered to and to curtail scrap losses, particularly upon machine start-up and on change-over from one product to another (having different specifications), the undulating profile of a non-uniform mat was leveled out by appropriate manipulation of the various operational parameters. For example, burner pressures were varied in an attempt to increase deposits in the region of troughs and to decrease deposits upon the thicker regions of the mat. This was a complex procedure since a change in burner pressure at one burner, for example, a center burner, did not necessarily impart a corresponding mat thickness change at the mat center, or at any predetermined location, because of the changes in velocity and direction that were induced within the forming tube by a change in burner pressure. Also illustrative of the complexity of control techniques under the prior art is the phenomenon by which, in changing from one product to another of a different density, uniform pressure changes across the battery of burners would not necessarily result in a second product having a mat of uniform thickness.

Binder spray may also have an effect upon the lay of the fibers in the formation of the mat so that individual adjustment of the binder nozzle valves often resulted in difficulty in balancing the mat profile.

The aforementioned control methods have proved to be imprecise and often haphazard, and have been used with limited success only by those machine operators who have, through experience, developed the art of manipulating binder nozzles and burner pressures. Since a change in burner pressure necessarily results in a change in fiber diameter, the manipulation of burner pressures always involved the risk of moving fiber diameters out of specifications; the maintenance of a uniformity of fiber diameters being of great concern in the manufacture of fiber glass insulation and in particular in the making of filtration media. Manipulation of binder spray nozzles to achieve uniform fiber distribution impaired uniformity of binder distribution in the resultant mat.

Whenever there is a region of non-uniformity present with the body of a filter medium, whether due to variations in the density of material, fiber diameter or percentage of binder, the effective life and performance of the filter is sharply curtailed. Thus the fiber glass filter industry seeks to manufacture products having uniform characteristics within reasonably narrow tolerances.

BRIEF SUMMARY OF THE INVENTION

The present invention relates to an improved method and apparatus for producing a fiberglass mat of substantially uniform density and in one embodiment at substantially increased rates. According to the invention, maneuverable forming tubes and binder nozzles are provided. In the operation of the apparatus according to the invention, a battery of fiber generators discharges a gaseous stream of fibers into a corresponding group of stationary, elbow shaped conduits, which turn the fiber streams from a horizontal direction to be dischared downwardly towards a moving collection surface. Forming tubes are telescopically mounted over the downwardly sloped portions of the conduits and each can be moved in a pendulum-like fashion to the left or right of the center line of the stationary conduit to be secured in one of various orientations. Whenever there is a mat of uneven thickness being produced, the forming tubes can be individually maneuvered to direct the deposition of fibers so as to fill the low regions on the mat profile and to lessen the deposition of fibers on the high regions, so that a satisfactorily level mat-profile is quickly achieved. In the operation of a fiber mat machine according to the invention, a record is made of the forming tube setting best for each of the various fiber glass products produced on the machine. Thus, on machine start-up of any given product or change-over from one product to another the forming tubes may be adjusted to the appropriate predetermined setting.

Another feature of the invention lies in the fact that the telescopically mounted forming tubes, as a group, may be mounted with their discharge ends located at various selected distances above the collection surface.

This feature facilitates conversion of the machine to produce mats for differing end uses. For example, fiber glass insulation is generally produced at higher pull rates and burner pressures than fiber glass filter media and the attendant heat dissipation factor generally requires a shorter forming tube which readly can be provided by apparatus embodying the invention.

In one embodiment of the invention the fiber generators are arranged in two horizontally spaced apart lines with the generators of the first line being laterally staggered with respect to the generators of the second line. Gaseous blasts from generators of the first line issue in the direction of the second line of generators, and vice versa. The forming tubes and the lower portions of the elbow shaped conduits associated with the first line of burners interlay the forming tubes and conduits associated with the second line of burners. Forming tubes and conduits are sufficiently narrow to provide for their accommodation in a single transversely extending row within the width of the collection surface and also allow for the pendulum-like and vertical movement described above.

The invention also encompasses a binder application system having binder headers extending longitudinally along each side of the line of forming tubes and also positioned in the spaces between adjacent forming tubes. From each binder header extends a plurality of valve controlled means having nozzles disposed adjacent the discharge ports of the forming tubes for applying an atomized spray of binder from any angle or position necessary for efficiently and effectively coating the fibers. In flexibility of the binder application means complements the adjustability of the forming tubes and permits binder distribution to be held uniform when forming tubes are rearranged. Further, the universality of nozzle positioning allows precise adjustments that ensure a minimum of binder waste and uniformity of binder distribution upon the mat.

It is the primary object of the invention to provide an improved method and apparatus for depositing fibers onto a moving collection surface in a fashion which ensures uniform mat thickness.

A further object of the invention is to provide an improved method and apparatus for applying binder to the fibers.

A still further object is to provide method and apparatus for increasing the volume of fibers produced and deposited on the moving collection surface.

Other objects and advantages of the invention will be apparent from the detailed description of the preferred embodiment herinafter described.

BRIEF DESCRIPTION OF THE DRAWINGS

FIG. 3 is a fragmentary view in elevation taken from the left end of the apparatus as shown in FIG. 1.

DESCRIPTION OF PREFERRED EMBODIMENT

Figure 1:
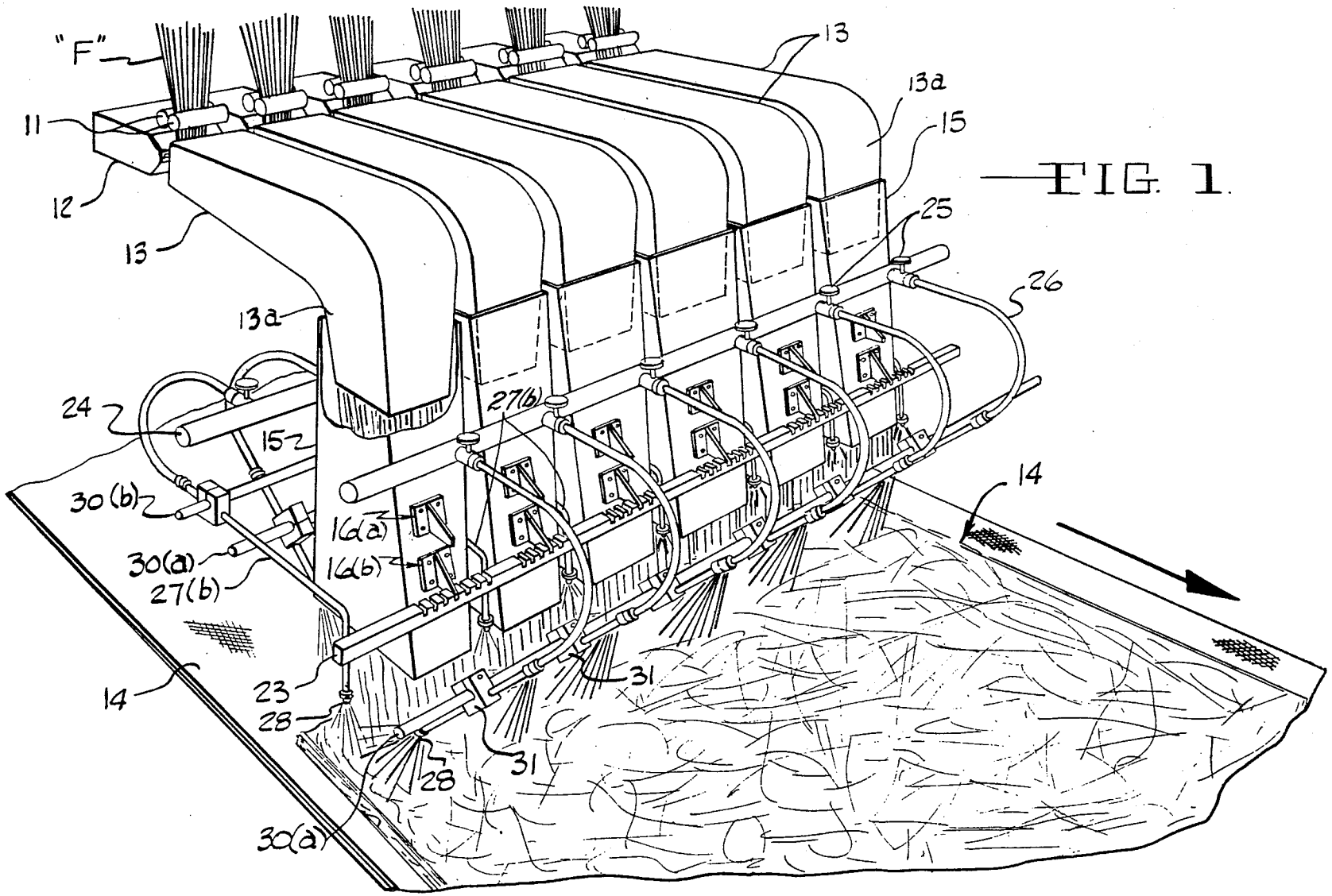
FIG. 1 is a view in perspective of a fiber mat producing apparatus according to the invention.

Referring to FIG. 1, relatively heavy primary glass filaments "F" are produced in a tier of aligned pots, not shown, and are fed into the nips of pairs of pull-rolls 11 rotating in synchronized relation to attenuate the glass filaments F. A plurality of burners 12 directs hot gaseous blasts in a substantially horizontal flight to further attenuate the filaments F into fine glass fibers. The gaseous blasts and induced air and the fibers entrained therein are conducted through fixedly mounted, elbow shaped conduits 13. The conduits 13, which are identical in configuration, turn the gaseous streams from the horizontal plane downwardly toward a moving foraminous collection surface 14. A corresponding number of forming tubes 15 telescopically fit over the downwardly directed portions 13*a* and the conduits 13.

Figure 2:
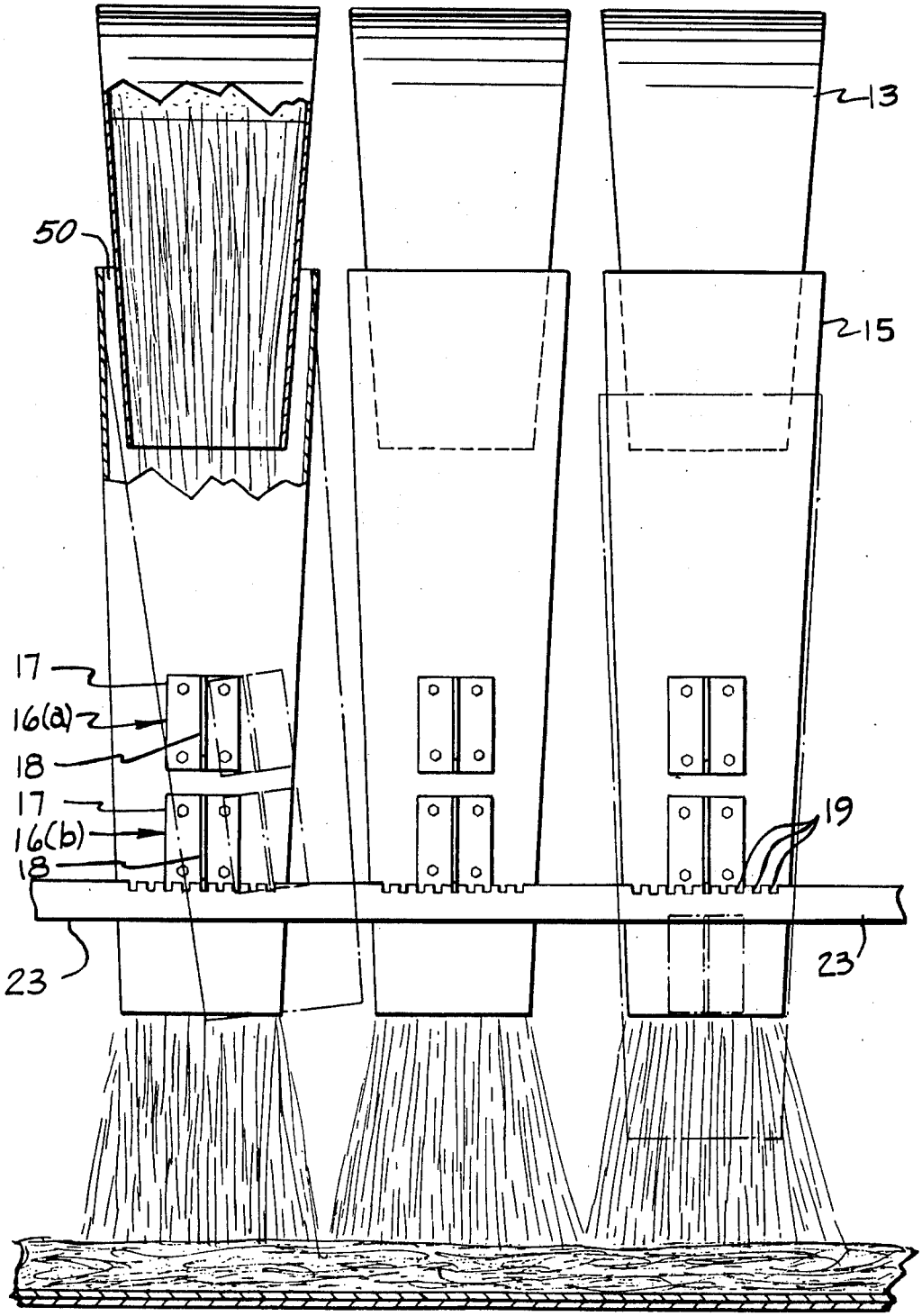
FIG. 2 is a fragmentary view in front elevation illustrating the forming tubes adapted to be supported in different angular orientations and vertical placements relative to the collection surface.
Figure 1:
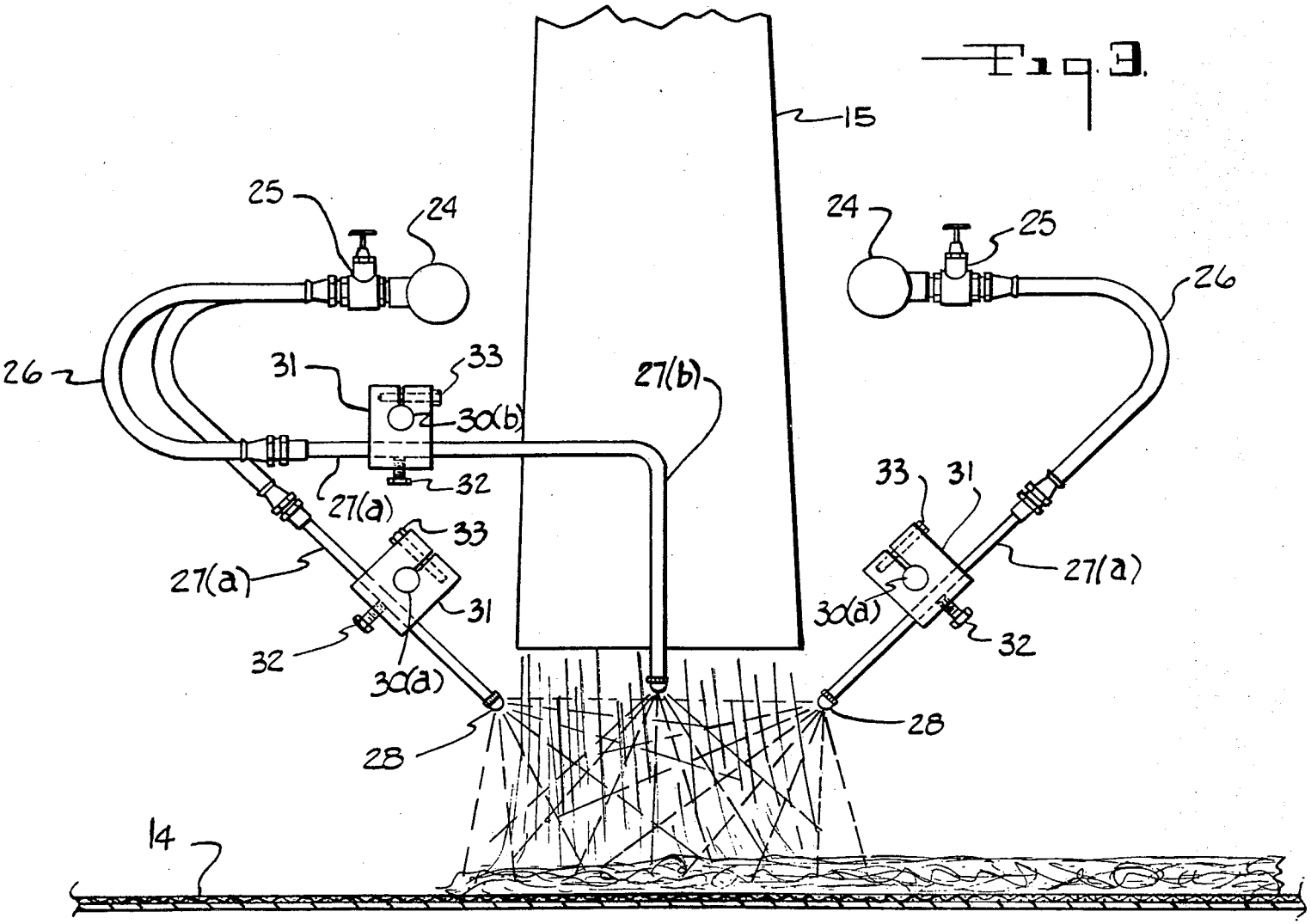

As shown in FIG. 2 the forward facing wall of each forming tube 15 has attached thereto upper and lower mounting frames 16(*a*) and 16(*b*), respectively, located one above the other in vertical alignment. Each mounting frame 16(*a*) or 16(*b*) comprises a base plate 17 and a vertical, forwardly extending bracket 18. The brackets 18 have lower edges which are generally horizontal and are adapted to engage any of a number of notches 19 which extend in discrete groupings along the upper edge of a fixedly mounted rack 23. The forming tubes 15 are supported and held stationary by the engagement of the mounting frame brackets 18 with selected ones of the notches 19.

A forming tube 15 can be disengaged from its mounting upon the rack 23 by being raised upwardly to the extent that the lower edge of the bracket 18 clears the top of the notches 19. Because of the stationary downwardly sloped portion 13*a* of the conduit 13, the upper portion of the forming tube 15 will remain relatively stationary and act as a pivot point to allow the disengaged forming tube 15 to be maneuvered in a pendulum-like fashion to the left or right of the centerline of the fixed conduit 13. The forming tube 15 then can be locked into a different selected angular orientation by being lowered so that the bracket 18 is seated into a different notch location on the rack 23.

The fixed conduits 13 and the forming tubes 15 are rectangular in cross-section, and a suitable material for their fabrication is 14-guage [.075 inch] 309 stainless steel. As may best be illustrated by FIG. 1 the apertures of the burners 12 have a rectangular configuration which is elongated in a direction transverse to the direction of movement of the collection surface, and similarly orientated are the corresponding blast receiving openings of each stationary conduit. As the conduits 13 turn downwardly their rectangular cross-sectional dimensions change to an elongation extending in the direction of movement of the collection surface. The forming tubes 15 have a configuration similar to the downward extremity of the conduit 13. The exit end of each forming tube 13 adjacent the collection surface has a rectangular configuation with the longer sides parallel to the direction of movement of the collection surface. The width of the exit end of the forming tubes is sufficiently narrow to provide the spacing between adjacent forming tubes to allow the desired lateral shifting of the lower portion of the forming tubes upon the mounting rack 23. In the telescoping regions of the tubes and conduits the clearance 50 between a tube 15 and a conduit 13 should be at the most large enough so as not to restrict the desired angular manipulations of the forming tubes 15. Clearances 50 also allow ambient air to be induced by the rapidly moving glass fiber streams into the forming tubes and consequently the glass fiber streams. The ambient air aids in cooling the fibers so that precuring of subsequently added binder is reduced.

As shown in FIGS. 1 and 3, high pressure binder headers 24 extend tranversely across the front and rear of the battery of forming tubes 15. A plurality of fluid valves 25, in parallel relationship, connects the binder headers 24 to a corresponding number of flexible high pressure hoses 26 which in turn are connected to binder applying pipes 27(*a*) or 27(*b*) and to binder atomizing nozzles 28. Also extending on both sides of the battery of forming tubes 15, in parallel spatial relationship to the binder headers 24 and mounting rack 23, are nozzle mounting shafts 30(*a*) and 30(*b*) which support binder pipe holders 31 upon the mounting shafts 30(*a*) and 30(*b*). The pipes 27(*a*) and 27(*b*) slidably fit through holes in the holders 31 and are clamped therein by locking screws 32.

There are two configurations of binder applying piping as is shown in FIG. 3. One is the straight piping 27(*a*) which is located on both sides of the forming tubes 15 and mounted upon the mounting shafts 30(*a*). The second style is a 90° angle piping 27(*b*) located on one side of the forming tubes 15 and supported on the mounting shaft 30(*b*). As FIGS. 1 and 2 show, the straight piping 27(*a*) is generally disposed to have a nozzle 28 adjacent the front and rear of each forming tube 15, and the 90° angle piping 27(*b*) is disposed in each of the spaces between forming tubes as well as at the outer side of each of the two end forming tubes.

An additional feature of the forming tubes 15 is that their elevation above the collection surface 14 can be changed. A forming tube 15 may be adjusted into its lower configuraton as shown in FIG. 2 by disengaging the lower mounting frame 16(*b*), tilting the forming tube rearwardly so that the forward edge of the bracket 18 clears the rearward edge of the notched rack 23 and then lowering the tube so that the bracket 18 of the upper mounting frame 16(*a*) engages the rack 23 at the desired notch location.

Figure 5:
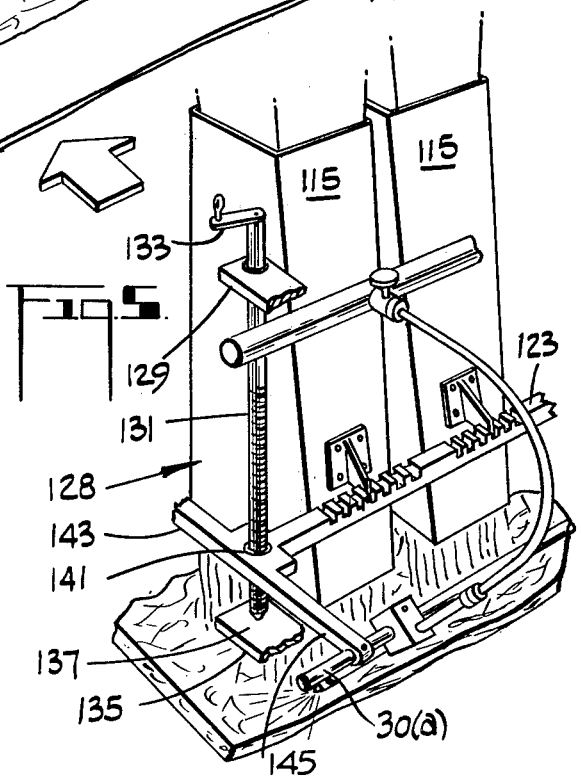
FIG. 5 is a fragmentary view in perspective with parts broken away, illustrating a different and preferred means for raising and lowering forming tubes.

A different and preferred means for altering the elevation of forming tubes 115 is disclosed in FIG. 5. According to this modification, both ends of the forming tube mounting rack 123 and the binder nozzle mounting shafts 30(*a*) and 30(*b*) (not shown) are fixedly attached to a common support member 143. A threaded bore formed in support member 143 at 141, receives a threaded portion 131 of screw mechanism 128. The lower end portion of screw mechanism 128 is mounted for rotation in thrust bearings 137 on structural member 135, and an upper smooth portion of screw mechanism 128 is journaled for rotation in structural member 129. The upper extremity of screw mechanism 128 terminates in hand crank 133. Rotation of hand crank 133 raises or lowers common support member 143. Thus, by manipulation of screw mechanisms 128 located at each side of the production unit the forming tubes as a unit, as well as the binder application nozzles, may be adjustably positioned at any elevation in the desirable range of distances above the collection surface.

Figure 4:
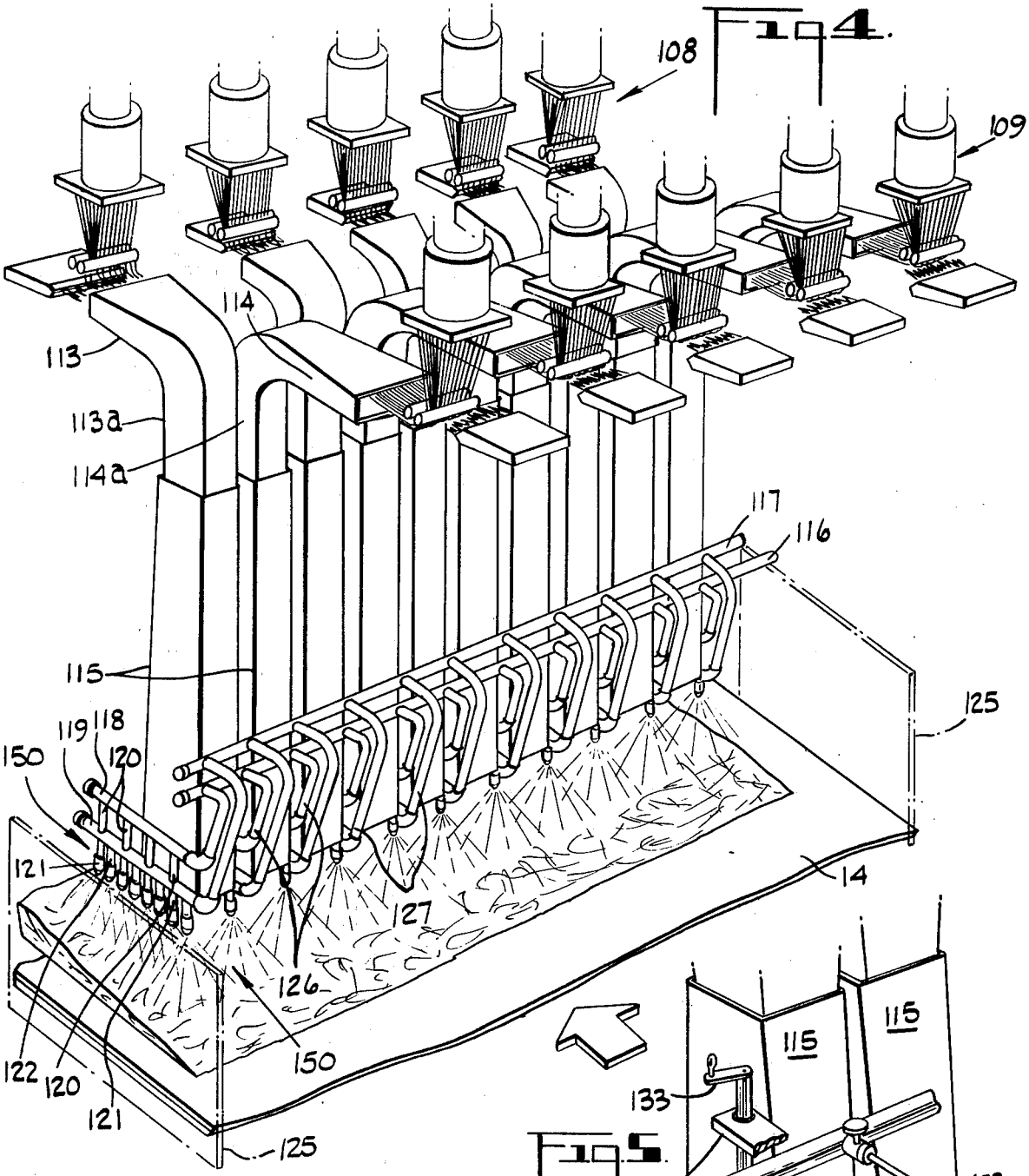
FIG. 4 is a view in perspective of a modified form of the apparatus shown in FIG. 1.

As shown in FIG. 4, at outer edge portions of moving collection surface 14 are located collection chamber sidewalls 125 having surfaces extending vertically to an elevation of approximately 10 feet above the collection surface. Although only the sidewalls 125 are illustrated in FIG. 4, it is to be understood that the ends of the forming tubes are arranged to discharge into forming chambers similar to those described in Canadian Pat. no. 980,969. The collection surface moves through the forming chamber in the same manner as in the Canadian Patent, and the collection of fibers upon the collection surface is enhanced by similar suction boxes. For optimal performance, the lower, open ends of the forming tubes 115 are located approximately between 11 and 12 feet above the collection surface 14, or from 14 inches to 26 inches above the upper edges of collection chamber walls 125.

In operation of the apparatus according to the invention, the angular orientation of the forming tubes 15, and thus the region below the open ends of the tubes, on the moving collection surface 14 at which the fibers are deposited, can be varied by manipulation of the forming tubes as described above. In bringing a given product into specification, the forming tubes 15 are appropriately manipulated by the machine operator so that the most nearly level mat profile is obtained, that is, so that fibers are uniformly distributed over a span defining the width of the mat. The proper forming tube notch settings for each product to be produced on the apparatus are noted and thus machine start-up for any given product and change-over from product to product is greatly facilitated.

It has been discovered that by adjusting the elevations and angular orientations of the open ends of the forming tubes in the manner herein afore-described, the blow back or splashing or fibers off the collection surfaces as well as the undesirable accumulation of fibers on collection chamber sidewalls are greatly minimized.

In the operation of the binder application system, binder solution is supplied under pressure from an external source to the binder headers 24. The binder solution is then fed through the binder nozzle valves 25, the flexible high pressure hoses 26 and then through the straight and the 90° angle binder applying pipes 27(*a*) and 27(*b*) to exit the nozzles 28 in the form of an atomized mist. By loosening and retightening the clamp screws 33 the angular orientation of the application pipes 27(*a*) and 27(*b*) in the plane normal to the mounting shafts 30(*a*) and 30(*b*) can be set. Also by loosening and retightening the clamping screws 33, the application pipes can be slid laterally along the mounting shafts 39(*a*) and 39(*b*) to be secured in the desired location along the shafts. Thus the straight binder applying pipes 27(*a*) are located in their preferred position at the front an rear of each forming tube 15 approximate the center line of each forming tube. Similarly the downwardly sloping portions of the 90° angle applying pipes 27(*b*) preferably are located between the forming tubes 15 and at the outside of each end forming tube 15 so as to be equidistant from the centerlines of the discharging fibrous streams. By loosening and retightening the locking screws 32, the downwardly sloping portions of the 90° angle pipes 27(*b*) preferably are located on both sides of each forming tube approximate the lateral centerline of the tubes. By loosening and retightening the locking screws 32 the lengths to which the straight applying pipes 27(*a*) extend from the pipe holders 31 is adjusted.

Thus, in the above described manner, the atomizing nozzles 28 may be located precisely in the desired positions on four sides of each of the exiting fibrous streams to achieve a spray which will ensure the most efficient and effective application of binder to the fibers.

As shown in FIG. 4, the spirit of this invention is as well adapted for use in a modified form of the invention in which the fiber generating apparatus is located in two spaced apart rows 108, and 109. The aligned fiber generators of row 108 and associated conduits 113 are laterally staggered with respect to the fiber generators of row 109 and the associated conduits 114. Conduits 113 and 114 taper from their wider blast receiving open ends to provide downwardly extending portions 113(*a*) and 114(*a*) having a narrower profile in the direction transverse the collection surface. The forming tubes 115 associated with both rows of fiber generators, have frontal profiles sufficiently narrow so as to permit their alignment in a single row within the transverse expanse of the collection surface. There are spaces between adjacent forming tubes 115 sufficient to accommodate the apparatus of a binder application system which is a modification of the basic concept shown in FIG. 1. This modification is described hereinafter. The forming tubes 15 are adjustably mounted in the novel manner as disclosed in the embodiment of FIG. 1. The combination of eleven fiber generators and associated ducting shown in this modified form of the invention has provided for an increase in the volume of fibers by five-sixths over the volume of fibers handled by the apparatus shown in FIG. 1 which results in a corresponding increase in mat making capacity of the machine while at the same time, because of the novel ability to adjust the forming tubes, the ability to generate a uniform mat thickness and an improved application of binder has been retained.

The binder application system shown in FIG. 4 features spray nozzle assemblies 150 located in each of the spaces between forming tubes as well as at the outer sides of each of the two end forming tubes. Each nozzle assembly 150 includes a pre-cure water manifold 118 and a binder manifold 119 which are vertically spaced apart in parallel relationship. Water conduits 120 extend downwardly from the water manifold 118 and pass through binder manifold 119 and terminate in water atomizing nozzles 121. Binder atomizing nozzles 122 extend downwardly from the binder manifold 119. These nozzles alternate with water nozzles 121 to provide a line of nozzles which extend across the side of each forming tube just below and adjacent the lower end thereof. A high pressure pre-cure water header 116 and a high pressure binder header 117 extend transversely across the battery of forming tubes. Flexible high pressure hoses 126 connect each of the water manifolds 118 with the high pressure water header 116 and flexible high pressure hoses 127 connect each of the binder manifolds 119 with the binder header 117. Suitable support members (not shown) connect the spray nozzle assemblies 150 with a means for altering the elevation of forming tubes 115 as disclosed in FIG. 5.

It is to be understood that various modifications may be made in the shape, size and arrangement of parts as well as the procedure herein disclosed without departure from the spirit and scope of the invention as defined in the appended claims.

What is claimed is:

1. Apparatus for producing a mat of glass fibers, comprising:

a plurality of laterally spaced apart fiber generators for producing gaseous streams of fibers moving in a generally horizontal direction;

a moving collection surface located below said fiber generators, said collection surface moving in a direction normal to the alignment of said generators;

a plurality of stationary conduits adjacent said generators, each of said stationary conduits having a generally horizontal portion for conducting said gaseous streams of fibers away from said generators and a downwardly extending portion for turning said gaseous streams of fibers from the generally horizontal direction and for directing said gaseous streams of fibers downwardly toward said collection surface;

a corresponding number of open-ended forming tubes communicating with the downwardly extending portions of said stationary conduits, the lower portions of said forming tubes having ends opening toward said collection surface, and means for mounting said forming tubes so that each forming tube may be individually or collectively fixedly positioned relative to the other forming tubes and at various angular orientations in a plane substantially perpendicular and transverse to the direction of the movement of said collection surface whereby fibers may be evenly distributed over the width of said collection surface.

2. Apparatus according to claim 1, wherein said forming tubes have upper portions that are telescopically located over the downwardly extending portions of said stationary conduits.

3. Apparatus according to claim 2, wherein said mounting means comprises brackets attached to a forward wall of each forming tube, said brackets having generally horizontal lower edges, and a stationary rack extending transverse to the forming tubes having a plurality of upwardly facing vertical slots adapted to be engaged by said lower edges.

4. Apparatus according to claim 2, further including elevation means for mounting said forming tubes to position the open ends of said forming tubes at various distances above said collection surface.

5. Apparatus according to claim 4, wherein said elevation means positions the open ends of said forming tubes 11 to 12 feet above the collection surface.

6. Apparatus according to claim 4, further including walls located on each side of the moving collection surface that extend upwardly from the outer edges of said collection surface proximate the region of fiber deposition upon said surface to an elevation of approximately 10 feet above said collection surface, wherein the open ends of said forming tubes are located approximately 14 to 26 inches above the upper edges of said walls.

7. Apparatus according to claim 4, wherein said elevation means comprises a plurality of brackets attached in vertically aligned tiers to the forward wall of each forming tube, each bracket having a generally horizontal lowr edge, and a stationary rack extending transverse to the forming tubes having a plurality of upwardly facing vertical slots adapted to be engaged by the lower edges of said brackets.

8. Apparatus according to claim 4, wherein said stationary conduits and said forming tubes have a rectangular cross-section, the gaseous stream receiving ends of said stationary conduits having a cross-section that is elongated in a direction transverse to the collection surface, and the forming tubes and said downwardly extending portions having a cross-section that is elongated in the direction of motion of the collection surface.

9. Apparatus according to claim 1, including a source of binder solution under pressure connected with a plurality of liquid atomizing nozzles, and means for adjusting the location of said nozzles circumjacent the open ends of the forming tubes.

10. Apparatus according to claim 1, wherein said fiber generators are aligned in two horizontally spaced apart rows, the generators of one row being laterally staggered with respect to the generators of the other row and wherein the gaseous streams produced by one row of said generators are initially generated in a direction opposite to the direction in which the gaseous streams of the other row are initially generated, said downwardly extending portions of said conduits and the associated forming tubes positioned adjacent to each other to form a single transversely extending row.

11. Apparatus according to claim 10, wherein said forming tubes have upper portions that are telescopically located over the downwardly extending portions of said stationary conduits.

12. Apparatus according to claim 11, including means for mounting said forming tubes to position the open ends of said forming tubes at various distances above said collection surface.

13. Apparatus according to claim 12, wherein said stationary conduits and said forming tubes have a rectangular cross-section, the gaseous stream receiving ends of said stationary conduits having a cross-section that is elongated in a direction transverse to the collection surface, and the forming tubes and the downwardly extending portions of the stationary conduits having a cross-section that is elongated in the direction of movement of said collection surface.

14. Apparatus according to claim 10, including a source of binder solution under pressure connected with a plurality of liquid atomizing nozzles and means for adjusting the location of said nozzles circumjacent the open ends of the forming tubes.

15. Apparatus for distributing an atomized mist of binder solution in a plurality of gaseous streams of glass fiber prior to collection of said streams on a moving collection surface, comprising:

a plurality of forming tubes through which said streams are conducted to said surface, said tubes being spaced apart and disposed laterally across said surface, said tubes having means for individually or collectively fixing said forming tubes at various angular orientations relative to each other and to said surface, said tubes also having means to elevate the tubes relative to said surface;

a source of binder solution under pressure;

liquid atomizing means connected to said source of binder solution, said atomizing means having a plurality of atomizing nozzles spaced about the periphery of the outlet of each of said tubes, at least one of said nozzles being juxtaposed between adjacent forming tubes, and means for adjusting the positions of each of said nozzles;

whereby an even distribution of binder solution within each of said streams may be effectuated.

16. A method of producing a mat of glass fibers comprising the steps of:

(a) generating a plurality of gaseous streams of fibers moving generally in a horizontal direction, (b) conduting said gaseous streams and turning them from said generally horizontal direction to a generally downward direction towards a moving collection surface, (c) selectively and fixedly diverting any one or more of said gaseous streams out of parallelism with the other streams to affect the collection pattern of said fibers on said collection surface, and (d) collecting fibers from said gaseous streams on said collection surface as a uniform mat of fibers.

17. A method of producing a mat of glass fibers according to claim 16, further including the steps of:

(e) atomizing a binder solution into a mist, and (f) adjustably distributing said mist in said gaseous streams prior to collection of the gaseous streams on said collection surface.

18. A method of producing a mat of glass fibers according to claim 16, wherein said gaseous streams are generated from opposite sides of a transversely extending vertical plane in the direction of said plane, and wherein said downward conduction of said gaseous streams occurs within said vertical plane.

19. A method according to claim 18, further including the steps of:

(g) atomizing a binder solution into a mist, and (h) adjustably distributing said mist in said gaseous streams prior to collection of the gaseous stream, on said collection surface.

20. Apparatus according to claim 2, wherein the inner extremity of the upper portion of each forming tube is spaced from the outer extremity of the downwardly extending portion of each stationary conduit, whereby ambient air may be induced into each forming tube by the gaseous stream of fibers moving through each forming tube.

21. A method according to claim 17, further including the step of inducing ambient air into said gaseous streams prior to distributing said mist.

22. Apparatus according to claim 11, wherein the inner extremity of the upper portion of each pg,23 forming tube is spaced from the outer extremity of the downwardly extending portion of each stationary conduit, whereby ambient air may be induced into each forming tube by the gaseous stream of fibers moving through each forming tube.

23. A method according to claim 19, further including the step of inducing ambient air into said gaseous streams prior to distributing said mist.

* * * * *